US005924610A

United States Patent [19]

Willemin

[11] Patent Number: 5,924,610

[45] Date of Patent: Jul. 20, 1999

[54] DEVICE TO FACILITATE PUTTING ON SOCKS AND SIMILAR ARTICLES OF CLOTHING

[76] Inventor: Ignace Willemin, 2873 Saulcy, Switzerland

[21] Appl. No.: 09/067,797

[22] Filed: Apr. 28, 1998

[30] Foreign Application Priority Data

| | | | |
|---|---|---|---|
| Apr. 28, 1997 | [CH] | Switzerland | 0978/97 |
| Mar. 6, 1998 | [GB] | United Kingdom | 98810187 |

[51] Int. Cl.[6] ..... A47G 25/90

[52] U.S. Cl. ..... 223/112; 223/119; 223/111

[58] Field of Search ..... 223/111, 112, 223/118, 119

[56] References Cited

U.S. PATENT DOCUMENTS

| | | | |
|---|---|---|---|
| 339,258 | 4/1886 | Blerkhorn | 223/119 |
| 2,903,170 | 9/1959 | Ahn | 223/111 |
| 3,727,812 | 4/1973 | Weiss | 223/111 |
| 3,853,252 | 12/1974 | Scianimanico | 223/111 |
| 3,991,920 | 11/1976 | Hall | 223/111 |
| 4,072,255 | 2/1978 | Bogorad | 223/111 |
| 4,482,084 | 11/1984 | Beskin | 223/111 |
| 4,709,839 | 12/1987 | Tucker | 223/119 |
| 5,050,783 | 9/1991 | Hunter | 223/112 |
| 5,249,720 | 10/1993 | White | 223/112 |
| 5,513,783 | 5/1996 | White | 223/112 |
| 5,706,988 | 1/1998 | Moore | 223/111 |

FOREIGN PATENT DOCUMENTS

| | | |
|---|---|---|
| 2 316 903 | 7/1975 | France . |
| 2 452 908 | 4/1979 | France . |
| 2 425 827 | 5/1979 | France . |
| 2 712 162 | 5/1995 | France . |
| 723244 | 7/1942 | Germany . |
| 1021148 | 7/1958 | Germany . |
| 2940038A1 | 4/1981 | Germany . |
| 4438319A1 | 5/1996 | Germany . |
| 602 076 | 7/1978 | Switzerland . |
| 2296421 | 7/1996 | United Kingdom . |
| WO 95/14414 | 6/1995 | WIPO . |

*Primary Examiner*—Bibhu Mohanty
*Attorney, Agent, or Firm*—Seed and Berry LLP

[57] ABSTRACT

Device to facilitate putting on socks, bobby socks, stockings and similar articles of clothing. The device comprises two oblong arms connected together as tongs. The lower end of each arm includes a gripping jaw in the shape of a horseshoe. The two gripping jaws fit one into the other when the two arms are brought together. The sock can be slipped around the first gripping jaw, where it is held owing to a stop. The first gripping jaw keeps the sock open wide enough so that the tip of the foot can be slipped in and then the heel. By bringing the two arms together, the sock is pinched between the two gripping jaws. It is then possible to put on the sock and to pull it up along the calf of the leg without the user having to bend over. One of the gripping jaws has in addition a catch element enabling socks to be removed.

13 Claims, 4 Drawing Sheets

DEVICE TO FACILITATE PUTTING ON SOCKS AND SIMILAR ARTICLES OF CLOTHING

This invention relates in general to orthopedic devices. More specifically, this invention concerns a device to facilitate putting on socks and similar articles of clothing such as bobby socks or stockings, for example.

Many people, especially the elderly or handicapped, have difficulty in bending over and lifting their legs. These people often have great difficulty in putting on their shoes and stockings themselves, and especially in slipping on socks or similar articles of clothing, and thus are often forced to rely on the help of another person.

A number of devices have therefore been developed to aid such persons in putting on their socks or their stockings. Certain of these devices, such as those described in the French patent FR 2 712 162, the German patent DE 4 438 319, the British patent GB 2 296 421 or the U.S. Pat. No. 3,853,252, for example, consist in a sort of single hand-grip similar to a shoehorn. These devices do not allow socks to be held having upper, open ends which are very wide or very elastic, and they easily twist tighter socks. Other devices, such as that described in the U.S. Pat. No. 4,072,255, do not have a handle long enough to really ease the slipping on.

The U.S. Pat. No. 5,513,783 describes a device to assist in putting on stockings. This device is equipped with two jaws, which are inserted through the open, upper end of the stocking, and with a tongue which spreads and increases the opening of the stocking. This device is relatively expensive to manufacture, however, because it comprises three large parts which are articulated with respect to one another.

Other devices are described, for example, in the French patent FR 2 424 827 and in the German patent DE 2940038.

The object of the present invention is to propose a device to facilitate putting on socks which is improved over the prior art.

This object is attained according to the invention with a device designed as tongs having two oblong arms able to pivot, one with respect to the other, about a pivot point, one end of each arm on one side of the pivot point constituting a handle whereas the end of each arm on the other side of the pivot point constitutes a gripping jaw wherein the shape of the first gripping jaw allows it to be inserted in the open, upper end of the sock in such a way that the sock is held sufficiently open so that at least the tip of the foot can be passed through, and wherein the second gripping jaw fits around the first gripping jaw when the arms are brought together so as to pinch a sock between the outer face of the first gripping jaw and the inner face of the second gripping jaw.

The invention will be better understood from the description, given by way of example and illustrated with the annexed figures.

To simplify the description which follows and the claims, the term sock will be used to designate all kinds of socks, bobby socks, stockings and similar articles of clothing.

Figure 1:
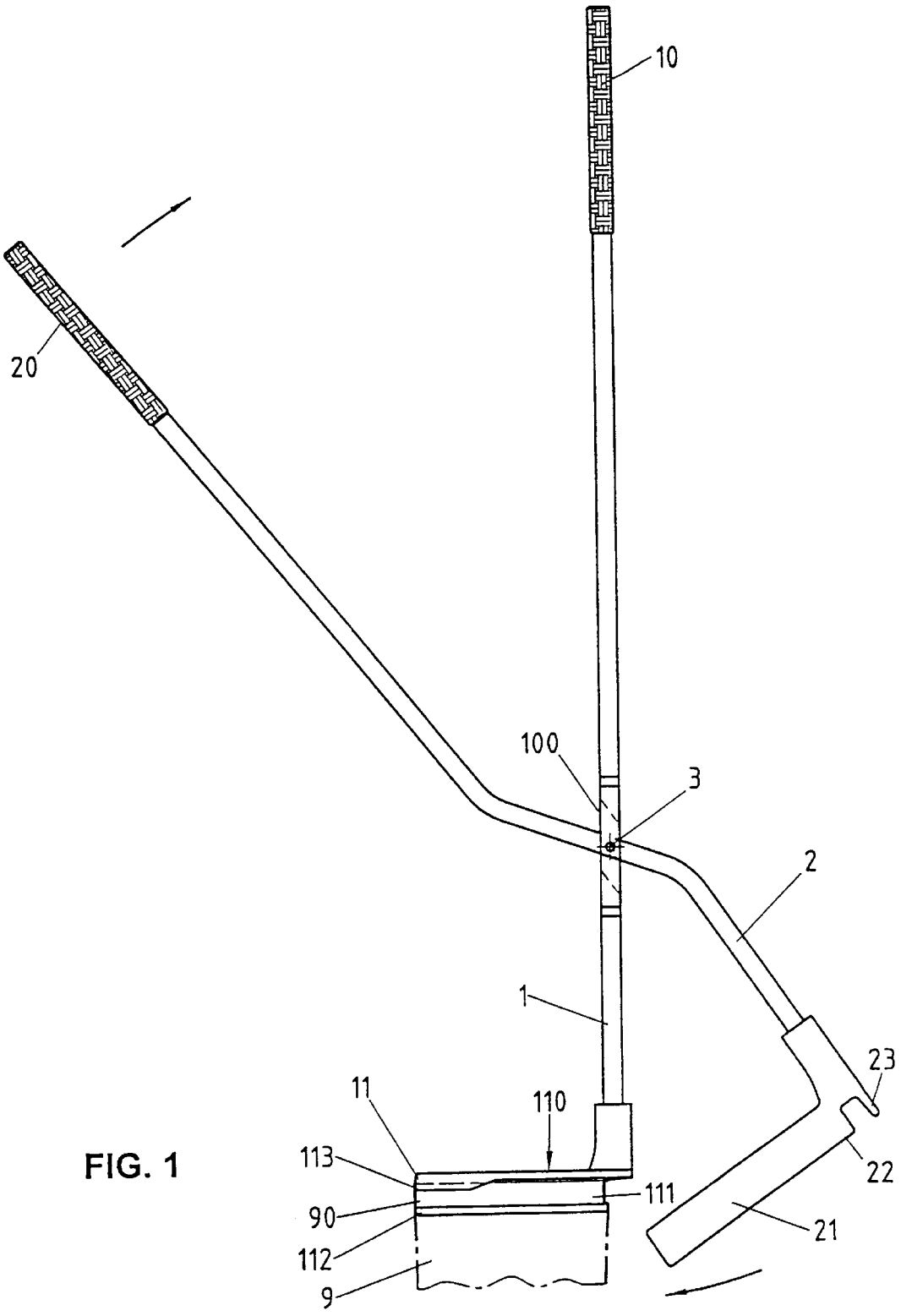
FIG. 1 is a side-face view of a device according to the invention with a sock slipped on and the two arms of the device spread apart.

As can be seen especially in FIG. 1, the device according to the invention comprises two oblong arms 1, 2 articulated like tongs. The arms can be made of metal, for example steel, aluminum, or another other suitable metal, and possibly anodized, or can be made of a molded or injected plastic. The weight of the assembled device is preferably limited so that even severely handicapped people can manipulate it. The arms 1, 2 are sufficiently long so that they prolong the arms of the user to the floor so that the user does not have to bend over at all or only very slightly. The two arms of the device are articulated about a hinge or pivot point 3 made up of a shaft, a pin or a rivet. A washer of Teflon® can be used to limit the wear and tear on the moving parts at the articulation level. In this example the middle part of the first arm 1 is enlarged and has a recess 100 traversed by the second arm 2 at the articulation level. In a variant, the two arms could simply be made up of two oblong elements 1, 2, assembled together, one against the other, by means of the hinge point 3. The upper part of each arm 1, 2 further comprises a handle 10, 20, preferably covered with a natural or synthetic material such as caoutchouc or leather. In the example illustrated, the handle is straight. However, a curved handle or a loop could also be used.

Figure 3:
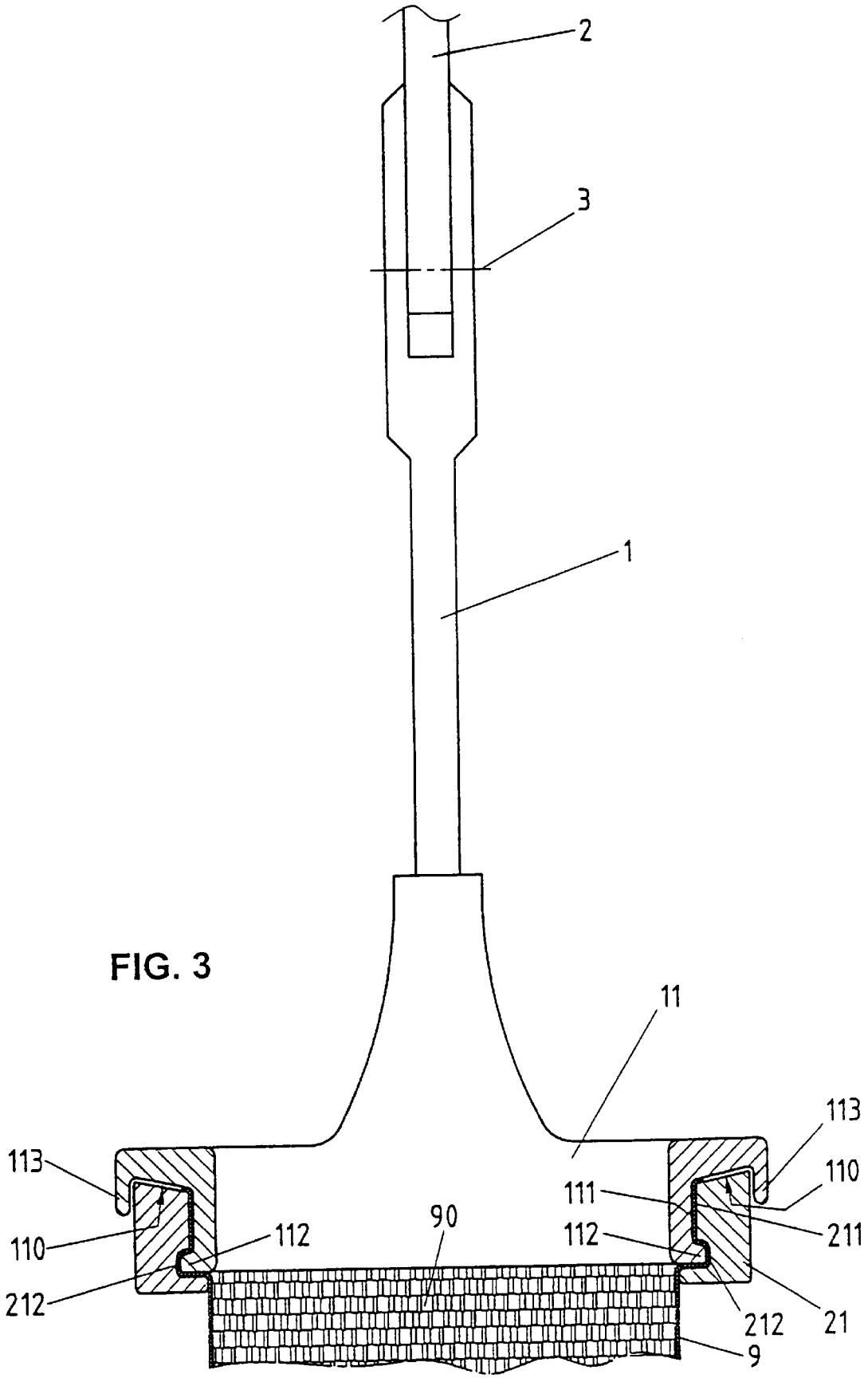
FIG. 3 is a front section of the lower portion of the device of FIG. 1.

The lower end of the first arm 1 is provided with a first gripping jaw 11 made up, in this example, of a horseshoe fixed approximately at a right angle with respect to the arm 1. The dimension of the horseshoe 11 corresponds to about the maximal opening which can support the open, upper end 90 of a sock 9 of ordinary size. A shape other than that of a horseshoe is also easily conceivable as long as it can also keep the upper end of a sock open. Nevertheless it is preferable to avoid completely closed forms, such as circles or ovals, in order to allow passage of the tip of the foot, then the heel, into the opening defined by the gripping jaw 11. The gripping jaw 11 further comprises a stop portion 110 (particularly visible in FIG. 3) intended to hold the upper end of the sock 9 and to prevent the gripping jaw 11 from being able to pass completely inside the sock. The stop portion 110, in the example illustrated, is disposed on the entire periphery of the gripping jaw 11. However, it would also be possible to use a smaller stop, for example consisting of one or more discontinuous elements on the periphery of the gripping jaw 11, or an excessive thickness of any suitable shape. In addition, to prevent any sliding of the sock 9, it is possible to provide the outer face 111 of the first gripping jaw 11 with a non-slip covering, for example with a rubberized covering or a relief structure in the material of the gripping jaw.

The lower end of the other arm 2 is provided with a second gripping jaw 21 whose shape corresponds approximately to the first gripping jaw 11. The inner dimension of the second gripping jaw 21 corresponds substantially to the outer dimension of the first gripping jaw 11. At least the inner face 211 of the second gripping jaw 21 can possibly be covered with caoutchouc or given another nonslip covering. By bringing the two arms together maximally, in the direction indicated by the arrow in FIG. 1, the two gripping jaws 11, 21 fit together, the inner face 211 of the second gripping jaw 21 coming to press against the outer face 111 of the first gripping jaw 11, in such a way as to pinch a sock 9, which has been slipped around the first gripping jaw 11, between these surfaces, and to hold it. As can be seen particularly in FIG. 3, the outer face 111 of the first gripping jaw comprises in this preferred embodiment an annular projection 112 coming to lodge itself in closed position in a corresponding groove 212 of the second gripping jaw 21 in such a way as to hold the sock better. In a variant, this placement could be reversed: the projection would then be provided on the inner face 211 of the second gripping jaw 21 to become engaged in a groove provided on the outer face 111 of the first gripping jaw 11.

A peripheral, projecting stop 113 on the outer edge of the first gripping jaw 11 allows the two gripping jaws to be kept firmly fitted together. The stop 113 can be disposed on the entire periphery of the first gripping jaw 11, or preferably as illustrated, just close to the two free ends of the gripping jaw. The shape of the stop 113 preferably allows the two gripping jaws to be closed with an audible click or snap.

The two gripping jaws 11 and 21 are preferably made of a molded or injected synthetic material, and are connected to the arms 1 and 2 by gluing, clamping or riveting, for example. Metallic gripping jaws 11 and 21, however, can also be made within the framework of this invention. The manufacture of gripping jaws which are distinct from the arms offers an advantage over a single piece construction in that it limits the size of the required injection molds.

The function of the first gripping jaw 11 is to spread apart the opening 90 of the sock 9, whereas the second gripping jaw 21 only serves to hold the sock against the first gripping jaw. Thus, in a variant embodiment, the second gripping jaw 21 could be made up of a horseshoe having two ends which are less long than those of the first gripping jaw 11, but which is nevertheless able to fit together around the first gripping jaw.

Figure 2:
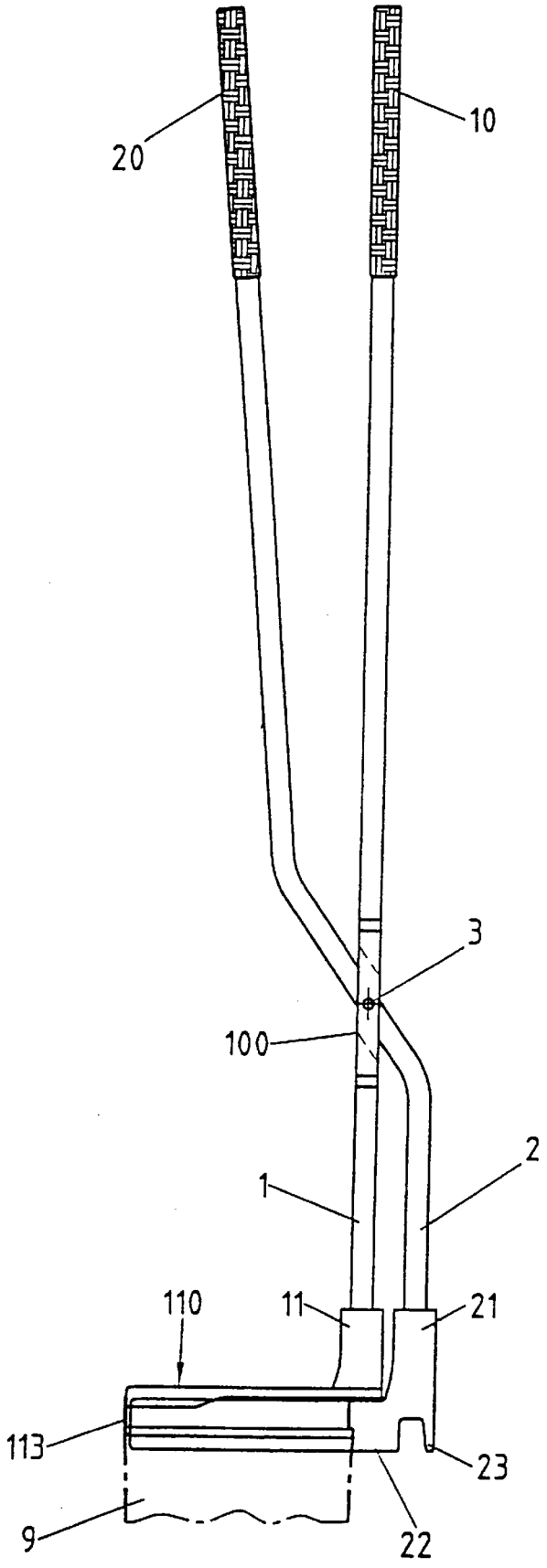
FIG. 2 is a side-face view of the device of FIG. 1 with a sock slipped on and the two arms brought together to hold the sock.

It will be further noted, particularly in FIG. 2, that the second arm 2 preferably comprises a foot 22 allowing the assembled device to be placed vertically on the floor with the two arms brought together without toppling over. The device is in contact with the floor at the foot 22 and at the first and/or second gripping jaw 11/21. This feature allows the device to be stowed away vertically, and thus users have easy access to it without stooping over.

The second jaw preferably further comprises a catch element 23 on its lower surface, allowing socks to be removed.

The user wishing to put on a sock 9, first slips it by its open, upper end 90 onto the first gripping jaw 11, preferably with the fore-part of the sock pointing in the same direction as the open side of the gripping jaw 11. The sock is thus sufficiently open to permit the foot to ultimately pass through. The two arms 1, 2 are then brought together in such a way that the upper end of the sock is pinched between the outer face 111 of the first gripping jaw 11 and the inner face 211 of the second gripping jaw 21. The two gripping jaws preferably have a sufficient amount of elasticity to ensure adequate holding of the sock. The stop 110 prevents the sock from climbing up at that moment along the arm 1. The user can then easily pass the tip of his or her foot, then the heel, through the large, open upper end 90 of the sock 9, then slide the sock up along his or her calf by pulling the device upward along the leg. When the sock has slid up sufficiently, the two arms 1, 2 are then spread apart in such a way as to free the sock. The second sock can then be put on in a similar manner.

The socks 9 can be taken off later by inserting the catch element 23 between the calf and the sock and by pushing the sock down toward the heel.

None of these operations requires the user to bend over, thus allowing him or her to put socks on effortlessly and without help from another person.

Figure 4:
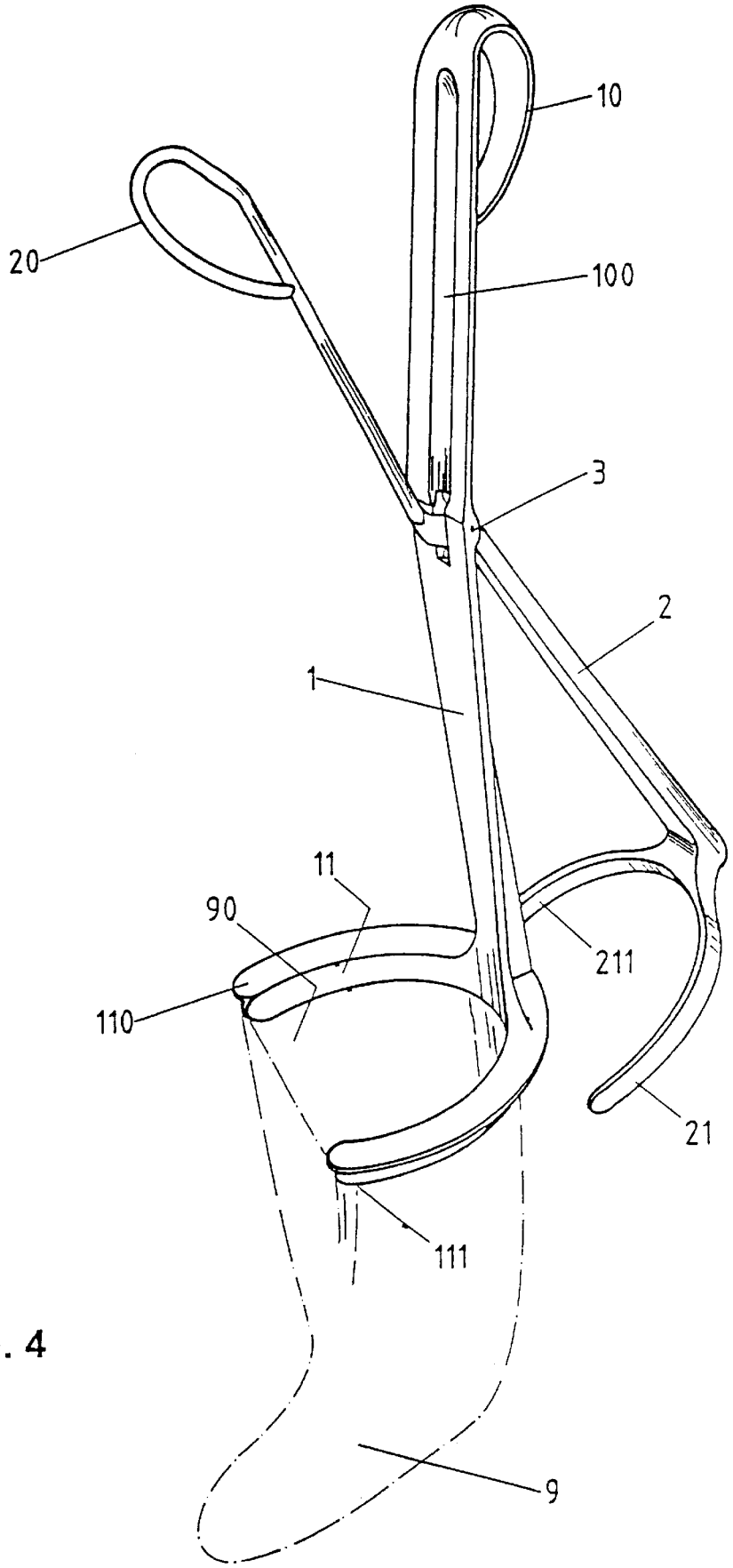
FIG. 4 is a view in perspective of a device according to a second variant embodiment of the invention.

FIG. 4 illustrates the device for putting on socks according to a second variant embodiment of the invention particularly adapted to economical manufacture in very large series. In this variant, the gripping jaws 11, 21 and the arms 1, 2 are each made of a single molded or injected piece. Using arms which are also made of synthetic material makes it possible to adopt a shape which is more ergonomic and aesthetic than with metal, while at the same time reducing the weight of the device. Of course this variant can also be provided with a catch element 23 for removing the socks and with a projection and corresponding groove 112-212 to improve the holding of the socks. The other features are the same as those described for the first variant.

The device according to the invention can be made in several lengths adapted to persons of differing height. Devices having different openings of the gripping jaws can also be proposed corresponding to different ranges of foot size. It is also possible within the framework of this invention to provide two different-sized sets of removable gripping jaws.

What is claimed is:

1. Tongs to facilitate slipping on socks and similar articles of clothing comprising two oblong arms able to pivot, one with respect to the other, about a pivot point, one end of each arm on one side of the pivot point constituting a handle whereas the end of each arm on the other side of the pivot point constitutes a gripping jaw wherein the shape of the first gripping jaw allows it to be inserted in an open upper end of the sock in such a way that the sock is held sufficiently open so that at least a tip of a foot can be passed through, and wherein the second gripping jaw fits around the first gripping jaw when the arms are brought together so as to pinch a sock between the outer face of the first gripping jaw and the inner face of the second gripping jaw.

2. The tongs according to claim 1, wherein the first gripping jaw has a horseshoe shape.

3. The tongs according to the claim 2, wherein the second gripping jaw has a hosreshoe shape, the inner diameter of the second gripping jaw being approximately equal to the outer diameter of the first gripping jaw.

4. The tongs according to the claim 3, wherein said gripping jaws are fixed approximately perpendicular to the end of said arms.

5. The tongs according to claim 1, wherein said first gripping jaw includes s stop edge intended to come into contact with the open, upper end of the inserted sock in such a way that said first gripping jaw is prevented from being able to pass to the bottom of the sock.

6. The tongs according to claim 1, wherein one of the two gripping jaws has a projection able to become engaged in a groove provided on the corresponding face of the other gripping jaw.

7. The tongs according to claim 1, wherein the two gripping jaws comprise a peripheral, projecting stop allowing the two gripping jaws to be closed again with an audible snap and to be kept closed.

8. The tongs according to claim 1, further comprising a catch element enabling socks to be removed.

9. The tongs according to claim 1, wherein said arms are made of metal.

10. The tongs according to claim 1, wherein at least one of said gripping jaws is made of plastic.

11. The device according to claim 9, wherein at least one of said arms is covered with plastic.

12. The tongs according to claim 1, wherein said arms are each made of a single piece of molded or injected synthetic material.

13. The tongs according to claim 1, wherein the device can be placed vertically on the floor without toppling over.

* * * * *

UNITED STATES PATENT AND TRADEMARK OFFICE

CERTIFICATE OF CORRECTION

| | | |
|---|---|---|
| PATENT NO. | : | 5,924,610 |
| DATED | : | July 20, 1999 |
| INVENTOR(S) | : | Ignace Willemin |

It is certified that error appears in the above identified patent and that said Letters Patent is hereby corrected as shown below:

In item [30], delete "[GB] United Kingdom" and substitute therefor -- [EP] Europe --.

In column 4, line 33, delete "hosreshoe" and substitute therefor -- horseshoe --.

In column 4, line 40, delete "includes s" and substitute therefor -- includes a--.

Signed and Sealed this

Third Day of October, 2000

*Attest:*

Q. TODD DICKINSON

*Attesting Officer*

*Director of Patents and Trademarks*